United States Patent [19]

Nadratowski

[11] 4,078,838

[45] Mar. 14, 1978

[54] DOGGIE VALET

[76] Inventor: Robert W. Nadratowski, 423 Broad Ave., Palisades Park, N.J. 07650

[21] Appl. No.: 762,038

[22] Filed: Jan. 24, 1977

[51] Int. Cl.[2] ..... A47F 13/06

[52] U.S. Cl. ..... 294/19 R; 294/1 R

[58] Field of Search ..... 294/19 R, 1 R, 55, 99 R, 294/100, 115, 116; 119/1 R; 248/99; 135/47, 58, 59

[56] References Cited

U.S. PATENT DOCUMENTS

| | | | |
|---|---|---|---|
| 3,093,402 | 6/1963 | Sisson | 294/19 R |
| 3,265,429 | 8/1966 | Shatt | 294/19 R |
| 3,663,049 | 5/1972 | James | 294/55 |
| 3,819,220 | 6/1974 | Bredt | 294/1 R |

*Primary Examiner*—James B. Marbert
*Attorney, Agent, or Firm*—Richard L. Miller

[57] ABSTRACT

An implement for picking up dog's feces in a sanitary manner so to be disposed; the implement including a disposable plastic bag loosely fitted around a lower end of a tube and being attached to a plunger inside the tube so that when the plunger is upwardly pulled in the tube, the bag rolls around the tube lower end and into the tube, taking with it any feces that is contacted by the moving bag so that the feces is thus enclosed inside the bag which is then discarded into any convenient refuse receptacle.

7 Claims, 6 Drawing Figures

10
11
12
12a
13
14
15
16
17
18
19
20
21
22
23
24
25
25a
26
27
28
29
30
31
32
40
41
42
50
51

DOGGIE VALET

This invention relates generally to dog feces removing implements.

A principal object of the present invention is to provide an implement that picks up pet feces in a sanitary manner by eliminating any possibility of a person physically touching the same, and which eliminates need to bend down to reach it so that there is less possibility to even smell the same.

Yet a further object is to provide a doggie valet wherein the tool itself does not in any manner come into contact with the feces so that it remains clean at all times.

Yet a further object of the invention is to provide a doggie valet which can pick up droppings from a floor or carpet inside a home or from a pavement or lawn out of doors, and which is suitable for use by owners of dogs or other pets such as cats.

Yet a further object accordingly is to provide a doggie valet which will keep pavements and parks clean and prevent transmission of diseases between pets.

A further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4, 5, 6:
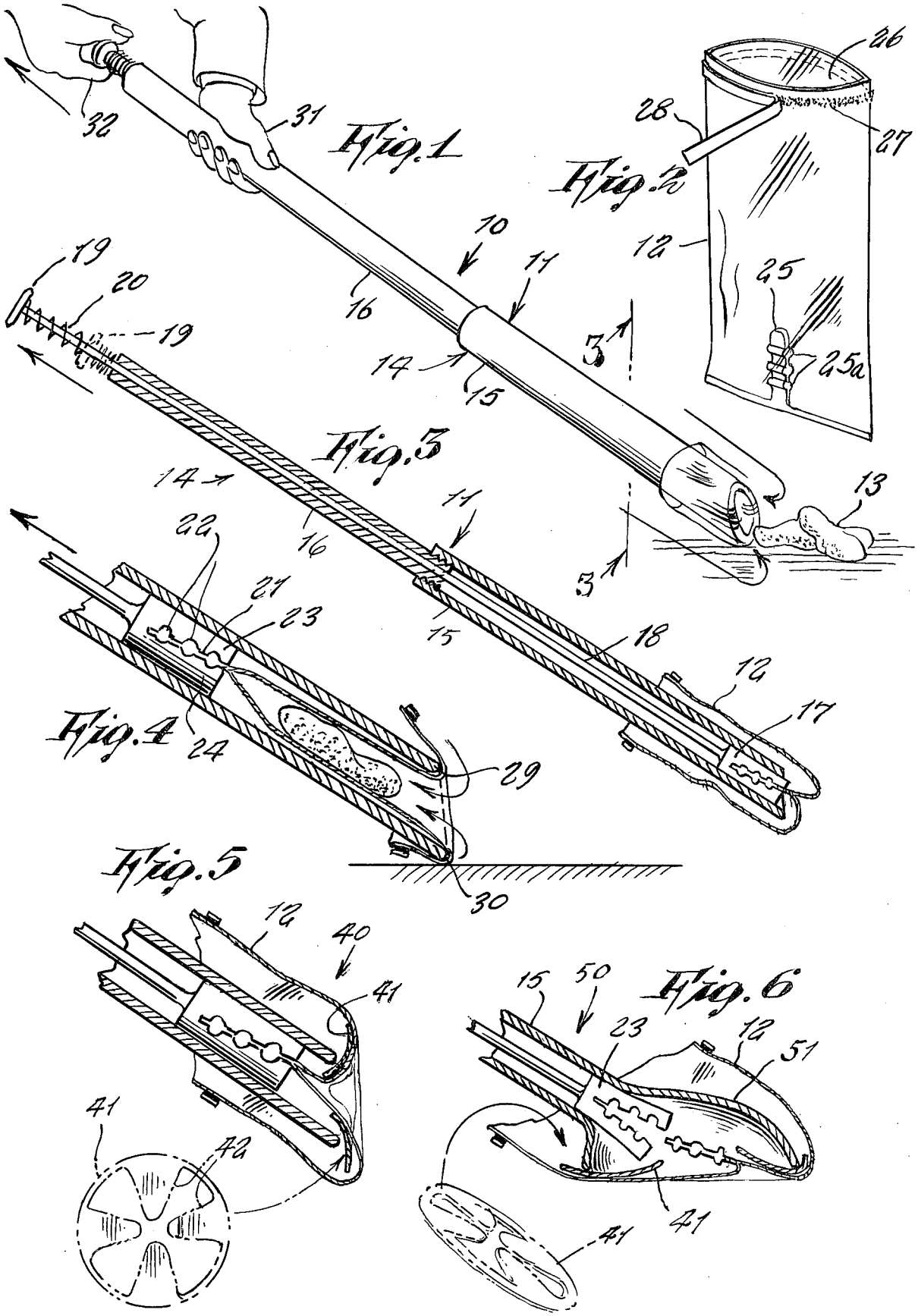
FIG. 1 is a perspective view of the invention shown in position ready to pick up an excrement of a pet.
FIG. 2 is a view of a disposable bag used in the present invention.
FIG. 3 is a cross sectional view on line 3—3 of FIG. 1.
FIG. 4 is a fragmentary similar view shown with the feces having been picked up.
FIG. 5 and FIG. 6 are cross sectional views of similar to FIG. 4, and illustrating modified designs thereof.

Referring now to FIGS. 1 through 4 at this time, the reference numeral 10 represents a doggie valet according to the present invention wherein there is an implement 11 and a replacable, disposable, plastic bag 12 attachable to the implement, and for receiving a pet's feces 13.

The implement includes a telescopic or collapsible tube 14 comprised of sections 15 and 16 within which there is a slidable piston or plunger 17 integral with telescopic rod 18 which protrudes from an upper end of the tube and is integral with a knob 19. A compression coil spring 20 around the rod bears at one end against the upper end of the tube and at its upper end bears against the knob. The plunger made of resilient material such as plastic or rubber has a longitudinal split 21 having a series of transverse grooves 22, the split forming jaws 23 and 24 that normally spread apart when relaxed (as shown in FIG. 6) so that the bag can be inserted into the split for connection to the plunger.

The disposable bag of thin polyethylene, has a tongue 25 on a closed bottom end of the bag, the tongue extending into the interior of the bag and having transverse beads 25a for fitting in grooves 22 when the tongue is grasped between jaws 23 and 24. A mouth 26 at the opposite end of the bag has an edge which has a pressure sensitive adhesive 27 around the outer side thereof and which is covered by a protective paper tape 18 prior to use and which can be readily peeled off.

In use, the bag is connected to the plunger as stated, and the bag is then rolled around the rounded lower end edge 29 of the tube and upward around the outer side thereof, as shown in FIGS. 1 and 3. It is to be noted the tube end edge 29 is at an angle so to form a point 30. The implement is then held by hands 31 and 32, as shown in FIG. 1, with the lower end of the bag fitted point 30 being positioned adjacent a feces 13. When the plunger is upwardly pulled, frictional contact of the bag and a lower air pressure inside the lower end of the tube caused by the receding plunger together cause the feces to be picked up by the bag and pulled into the interior thereof, as the bag rolls around the end edge 29 and into the tube, as shown in FIG. 4. At this time, the tape 28 is peeled off and the bag end is closed so the adhesive 27 on opposite side walls of the bag are thus brought together so to seal the bag closed with the feces inside. The plunger is then pushed down and outward of the tube (as shown in FIG. 6) so to release the bag which is then disposed of. Thus the person and the implement do not contact the feces in any way.

In FIG. 5, a modified design 40 of the invention is the same as above described, except that it additionally includes a flexible plastic ring 41 placed against the end edge 29, the ring having radially inward tongues 42.

In use, as the bag is pulled into the tube with the feces, the tongues serve to prevent any feces falling back out from the bag. This would be particularly ideal where a stool is of pellet or small round shape. The ring remains clean in use so to be reusable.

In FIG. 6, another design 50 can also employ the ring 41. This design of the invention includes a hard cup 51 formed on the lower end of the tube and which would be particularly suitable to enclose a large volume of feces when attempting to pick it up.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A doggie valet implement for picking up pet feces dropped onto a surface, comprising in combination, a tool and replacable bags attached to said tool, said tool comprising a tube containing a slidable plunger integral with a rod protruding from an upper end of said tube and ending in a knob, a compression coil spring between said tube upper end and said knob, the lower end of the plunger having grasping means for holding the bag, said bags comprising one end which can be grasped by said grasping means while the other end fits around the lower end of the tube as a sleeve, and wherein said other end of the bag is slid off the lower end of the tube and pulled inside the tube as the plunger is pulled upwardly in the tube.

2. The combination as set forth in claim 1 wherein said plunger is forked by including a slit between two jaws for grasping said bag.

3. The combination as set forth in claim 1 wherein both said tube and said rod are telescopically constructed so that the doggie valet may be collapsed.

4. The combination as set forth in claim 1 wherein a lower end of said tube is cup shaped.

5. The combination as set forth in claim 2 wherein said bag is made of thin polyethylene, having a mouth at one end, and an extending tongue on an opposite closed end, said tongue extending inwardly into said bag, said one end of said bag having a pressure sensitive adhesive around its outer side covered by a removable paper tape.

6. The combination as set forth in claim 5 wherein said slit is transversely notched and said tongue has matching transverse beads.

7. The combination as set forth in claim 6 wherein a resilient ring having inward tongues is slidably fitted around said bag.

* * * * *